US005728048A

United States Patent [19]

Hirschfeld

[11] Patent Number: 5,728,048

[45] Date of Patent: Mar. 17, 1998

[54] BACK CONDITIONING APPARATUS

[76] Inventor: Kurt Allen Hirschfeld, 35 West Shore Rd., Belvedere, Calif. 94920

[21] Appl. No.: 607,118

[22] Filed: Feb. 26, 1996

[51] Int. Cl.[6] ..... A61H 1/02

[52] U.S. Cl. ..... 601/24; 601/26; 601/35; 606/242; 482/907

[58] Field of Search ..... 601/5, 23, 24, 601/26, 33–35; 482/142, 907; 606/241, 242, 243, 245; 5/610, 612, 613, 616, 617, 618, 619, 624

[56] References Cited

U.S. PATENT DOCUMENTS

| | | | |
|---|---|---|---|
| 45,652 | 12/1864 | Taylor . | |
| 2,152,431 | 3/1939 | Jensen . | |
| 2,598,204 | 5/1952 | Allen . | |
| 2,724,428 | 11/1955 | Sellner . | |
| 2,749,911 | 6/1956 | Griffin | 606/242 |
| 2,931,354 | 5/1960 | Sellner . | |
| 3,005,633 | 10/1961 | Riemer . | |
| 3,015,330 | 2/1962 | Linstrom . | |
| 3,450,132 | 6/1969 | Ragon et al. . | |
| 4,723,537 | 2/1988 | Parker, Jr. . | |
| 4,834,072 | 5/1989 | Goodman | 482/142 |
| 5,050,589 | 9/1991 | Engle . | |
| 5,122,106 | 6/1992 | Atwood et al. | 482/907 |
| 5,258,019 | 11/1993 | Riddle et al. . | |
| 5,277,681 | 1/1994 | Holt | 482/907 |
| 5,282,835 | 2/1994 | Wright et al. . | |
| 5,320,641 | 6/1994 | Riddle et al. . | |
| 5,529,560 | 6/1996 | Davies, III et al. | 482/907 |

OTHER PUBLICATIONS

*The American Medical Association Guide to Back Care*, copyright 1984 Random House.

*Primary Examiner*—Jeanne M. Clark

*Attorney, Agent, or Firm*—Bielen, Peterson & Lampe

[57] ABSTRACT

A lower-back therapy apparatus that alternately stretches and strengthens lower-back, leg, and abdominal muscles, the apparatus is constructed with a platform unit having a flat cushioned platform table hinged to a motor-actuated, pivoting platform that can be pivotally raised and lowered by a control switch operated by the user, providing the user with complete control of the range, frequency and duration of the articulation of the pivoting platform for a user-defined stretching-strengthening sequence.

9 Claims, 3 Drawing Sheets

BACK CONDITIONING APPARATUS

BACKGROUND OF THE INVENTION

This invention relates generally to a user-operated, lower-therapy apparatus that allows a user to conduct an exercise therapy regimen. Specifically, this invention relates to a motorized lower-back therapy apparatus that is operationally controlled by the user.

Studies indicate that backaches account for the second highest number of visits to physicians' offices and also place second on the list of causes of absences from work due to illness. One doctor estimates that worldwide in this decade, there will be about 2 billion patients suffering from lower back pain.

There are many causes of back pain, ranging from chronic illness to physical injury to the natural aging process. Despite the myriad causes, physicians are frequently unable to pinpoint any specific cause for a given backache in a given person. Physicians often attribute these backaches to factors such as poor weight control and the "tired back syndrome", caused or exacerbated by the lack of stretching and exercise.

Patients frequently ignore medical advice to begin and maintain a simple exercise regimen, primarily because of the initial pain and effort involved. These patients frequently resort to the so-called traditional method of prolonged bed rest, leading to a vicious cycle of temporary relief followed by later pain flare-ups. Some of these patients end up combating their symptoms through drug therapy, unproven herbalistic therapies. Others find a doctor willing to attempt surgery.

An effective regimen for chronic or temporary back pain has been devised using a padded board that lays flat on the ground. Laying prone on the board, a user's hips are strapped to the board and a training partner raises and lowers the user's legs while stepping on the end of the board with one foot to hold it down. When the user's knees are locked, the raising and lowering of the legs by the training partner effectively and safely stretches the lower back muscles.

The primary problem with this system is that a training partner is required to assist in the mechanical operation of raising and lowering the user's legs. Importantly, the treatment of back pain is a sensitive operation and when movement of the user's legs is under the control of the training partner, inadvertent pain easily results from a lack of effective communication. Similarly, the necessity of relying on a training partner makes controlled, repetitive motions difficult to reproduce.

The problems with the prior art apparatus is solved by devising a therapy apparatus having a leg support that is mechanically raised and lowered under direct user control.

It is an object of this invention to provide a person suffering lower-back pain with a low-cost, comfortable, and efficient exercise apparatus that the user can operate without assistance and can control during operation.

SUMMARY OF THE INVENTION

The lower-back therapy apparatus of this invention is constructed with a flat platform unit having a stationary platform table hinged to a pivoting platform. A support frame supporting the platform unit houses a motor mounted in the frame and at least one motorized screw actuator connected to the pivoting platform. The motorized screw actuator pivotally raises the pivoting platform. To operate this apparatus, the user engages the actuator control, if necessary, to return the pivoting platform to its horizontal position. The user then lies prone on the platform unit, positioning his body so that his head, neck, back, and buttocks make contact with the stationary platform. The user's legs are supported by the pivoting platform. If desired, the user may place a small pillow underneath his head and a lumbar support underneath the small of his back.

The user then engages padded connecting straps snugly over his abdomen in order to maintain proper position once the motor is activated and the pivoting platform is raised. Once in this position, the user places his arms alongside his trunk and grips a handrail located on each side of the platform support structure to adjust his position.

The user now activates the motor to raise or lower the pivoting platform by lightly pressing one of the control buttons located on a hand-held actuator control that can be operated by either hand. Depressing the 'raise' button activates the motor to drive the screw actuator to smoothly raise the pivoting platform up to at least a maximum angle of 110 degrees from horizontal. Depressing the 'lower' button activates the motor to engage the screw actuator to smoothly lower the pivoting platform until it is horizontal. The user can stop the raising or lowering of the platform by removing pressure from the control buttons, at which time the pivoting platform will remain stationary in its current configuration angle.

Some users may desire to control the speed of the raising and lowering of the platform to provide increased comfort; for example, a user having a stiff lower back may desire to begin a treatment regimen whereby his legs are slowly raised and lowered. Then as the user's back muscles loosen, he can increase the speed of the motion. The therapy apparatus preferably has additional controls that are particularly useful for a prescribed therapy regimen. This apparatus includes a timer for regulating the duration of use and an angle control for limiting the angle that the platform can be raised, the angle control having an indicator for indicating the angle position of the platform during use.

In the typical exercise therapy process the user conducts a set of repetitions of raising his lower body from the horizontal position until the pivoting platform has made the desired maximum angle from horizontal, and then lowering the pivoting platform back to its horizontal position. In a preferred, full-feature embodiment, the pivoting platform is split, allowing each leg to be raised and lowered independently of the other. This is particularly useful for therapeutic use where injury may require independent treatment of a user's leg. These and other features will become apparent from a consideration of the Detailed Description of the Preferred Embodiments.

DETAILED DESCRIPTION OF THE PREFERRED EMBODIMENTS

Figure 1:
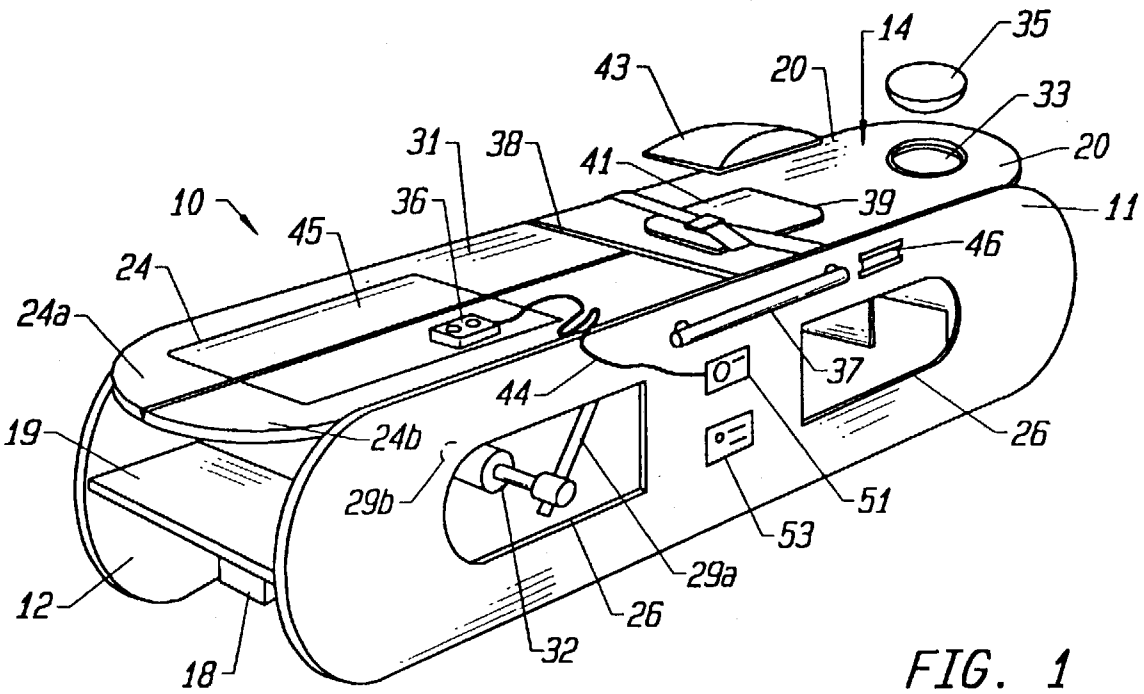
FIG. 1 is a perspective view of a preferred embodiment of the motorized lower-back therapy apparatus.

Referring to FIG. 1, the preferred, full-feature, back conditioning apparatus, designated generally by the reference numeral 10, is shown. The apparatus includes a support frame 11 with two frame members 12 that rest on the ground parallel to one another. The frame members 12 are spaced approximately 36 inches apart and support a platform unit 14. The platform unit 14 has a stationary platform 20 and a pivoting platform 24. The stationary platform 20 is connected to the pivoting platform 24 by a table hinge 38 described in greater detail in FIG. 3.

Figure 2:
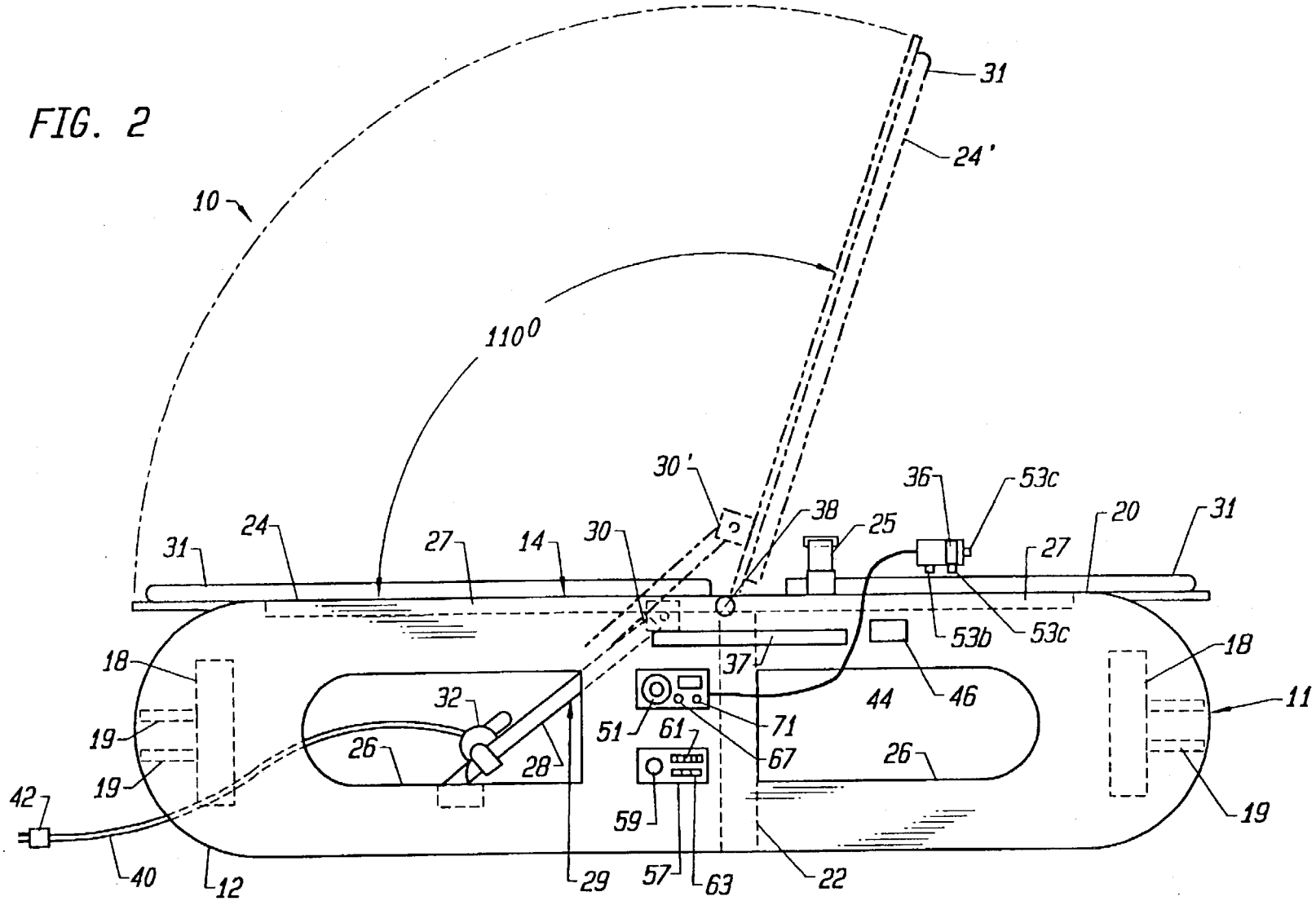
FIG. 2 is a side cross-sectional view of an alternate embodiment of the motorized lower-back therapy apparatus.

As shown in greater detail in FIG. 2, the platform unit 14 is supported between the frame members 12 on support rails 27. In the preferred embodiment, the frame members 12 are constructed out of wood and include hole elements 26 that permit ventilation and access to an actuator unit 29 located between the frame members 12.

The two frame members 12 are fixedly connected at each end by support members 18 and shelf members 19 that provide additional stability to the back conditioning apparatus 10. The shelf members 19 provide storage for towels and the like. A central bulkhead 22 is attached to the end of the stationary platform 20 that adjoins the pivoting platform 24 and is also attached to the two frame members 12. Padded connecting straps 25 are attached to the two frame members 12 approximately 6 inches from the end 30 of the stationary platform 20 that adjoins the pivoting platform 24 and are snugly fitted over the user's torso to ensure the user's lower-back remains in contact with the stationary platform 20 of the platform unit 14 during use. While operating the back conditioning apparatus 10, the user may grip handrails 37 attached approximately four inches below the top of the frame members 12.

Additionally, for added comfort, the platform unit 14 has a top pad 31 extending along the length of both the stationary platform 20 and the pivoting platform 24.

It is to be understood that the back conditioning apparatus can be constructed without all of the features of the full-featured embodiment of FIG. 1. In the embodiment of FIG. 1, the top pad 31 is configured to provide an elongated face recess 33 for the comfort of the user when lying face down on the platform unit 14, for example, during a back manipulation or massage. A padded plug 35 is placed in the recess 33 for use of the apparatus in its conventional function with the user lying on his back.

Additionally, a lumbar recess 39 is alternately filled with a flat pad 41, as shown in FIG. 1, or with a specially contoured lumbar support 43, as schematically shown elevated over the recess 39 in FIG. 1. The flat pad 41 alternately comprises a hot pack or cold pack for thermal treatment of the lower back. Also, to allow for adjustment of the user's legs on the pivoting platform 24, a slide plate 45 of Formica-like material is secured over or exposed by the pad 31.

In the full-featured embodiment of the back conditioning apparatus of FIG. 1, the pivoting platform 24 is split into separate sections **24*a* and 24*b* for independent articulation allowing each leg to be independently raised and lowered, or raised and lowered at a different angle than the other in a cycle because of injury or other reason for separate treatment. In such embodiment, the slide plate 45 is also split as shown, and each of the sections 24*a* and 24*b* has a separate actuator unit, the units designated 29*a* and 29*b*** in FIG. 1.

Referring to the side elevational view of the basic unit of FIG. 2, the pivoting platform 24 is a unitary platform with a single actuator unit 29. It is to be understood that the operation of the full-feature apparatus of FIG. 1 is essentially the same with independent control over each actuator unit 29.

As schematically shown in FIG. 2, the actuator unit 29 has an actuator screw 28 with an end bracket 30 connecting the screw 28 to the underside of the pivoting platform 24. In the extended position shown in broken line in FIG. 2, the actuator screw 28 is fully extended and positions the pivoting platform 24' connected at the bracket 30' at its maximum position, approximately 110° from the horizontal.

The actuator unit 29 is preferably constructed with a reversible stepping motor 32 with a worm gear connection to the actuator screw 28. In the preferred embodiment, the actuator screw 28 is a Granger Acme worm-gear screw. One end of the actuator unit 29 is pivotally connected to the support frame 11 and the opposite end is connected to the underside of the pivoting platform 24 by end bracket 30.

Connected to the reversible stepping motor 32 is a power cord 40 having a standard electrical plug 42 that is plugged into a standard electrical outlet and supplies electrical energy to the reversible stepping motor 32 under control of a control unit 47 located behind a control panel 51. The control unit 47 has the necessary circuitry connecting a pair of control panels 51 and 57 to stepping motor 32 and to a remote actuator control 36. The actuator control 36 is connected to the control unit 47 by a control cord 44. Alternately, using radio frequency communications, the remote control 36 may be in control communication with the control unit 47 without the use of a cord.

The remote actuator control 36 is grippable by either of the user's hands and includes a series of control buttons 53 and a small LCD display 55. The grippable actuator control 36 allows the user to control the angle between the pivoting platform 24 and the stationary platform 20 of the platform unit 14. The grippable actuator control 36 has raise and lower control buttons **53*a* and 53*b*, respectively. Preferably the actuator has a speed control button 53*c* to increase or decrease the angular speed of the pivoting platform 24. For the embodiment of FIG. 1, a tandem set of buttons is included on the actuator control. When not in use, the grippable actuator control 36 is attached to the frame 11 by one of two control holders 46, located alongside the handrails 37. A lower control panel 57 has a key operated, lock switch 59, preventing unauthorized use, a cumulative time meter 61 and an overload fuse 63. The upper panel 51 has a dial timer 65, to set the duration of the session, with an indicator light 67 to indicate that the timer 65** is activated and the system is operational.

The upper control panel 51 also has a small LCD 69 displaying the angle set by a step set button 71 which limits the extension of the actuator screw 28 by counter circuitry in the control unit, which counts the steps of the stepping motor and determines the position angle. The LCD display 55 of the grippable hand control 36 displays the same data as the panel display 69 and during operation, both displays 55 and 69 show the real-time angle of the pivoting platform. Where the apparatus has independently articulated sections of the pivoting platform 24, then the displays will show angles for left and right sections on a conventional split screen format.

Use of displays on both the control panel 51 and hand control 36 permits both a therapist and the user to monitor the operation of the apparatus.

Figure 3:
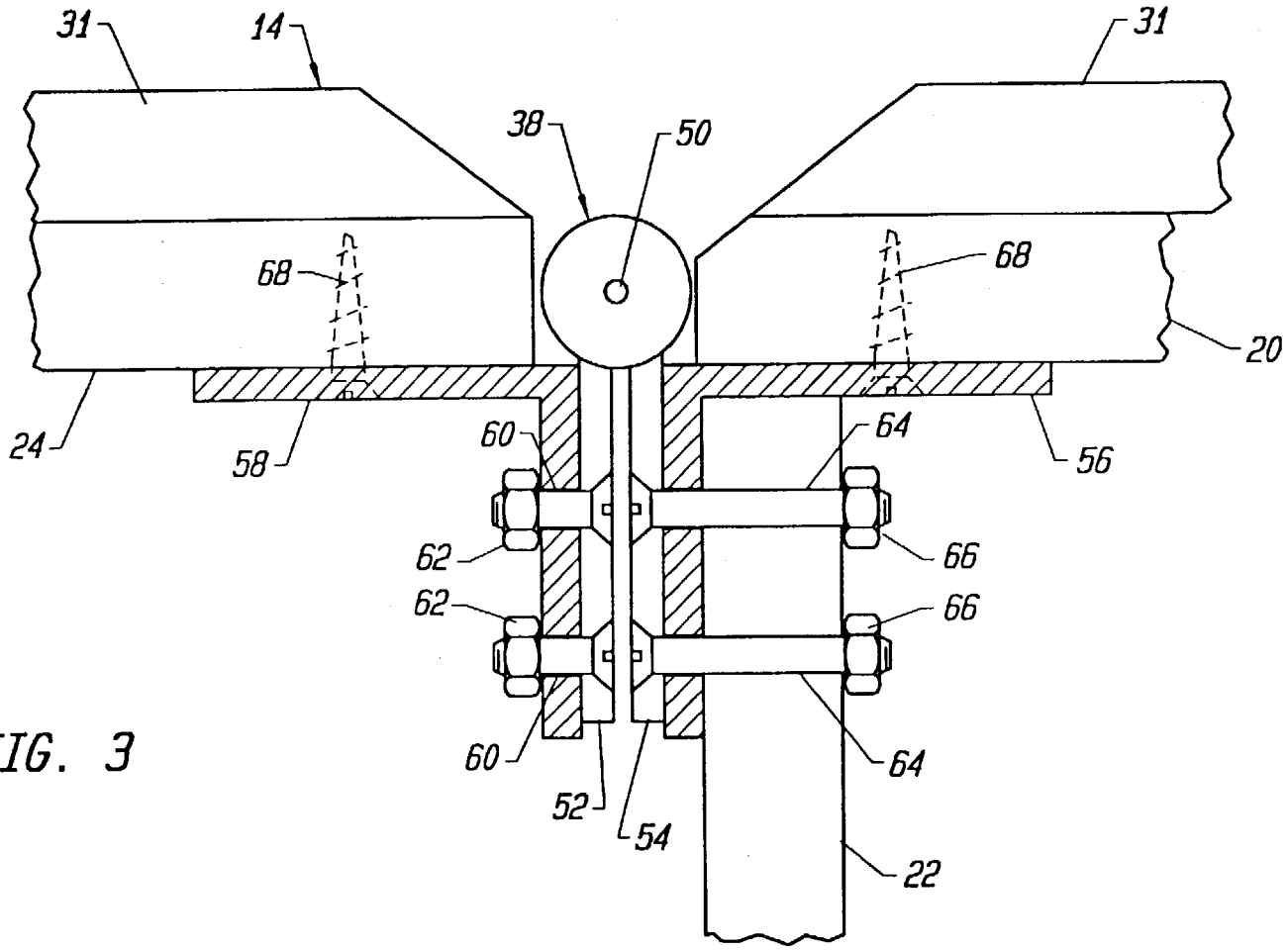
FIG. 3 is a side cross-sectional view of the central table hinge connecting the stationary platform element to the pivoting platform element.

Referring to FIG. 3, an enlarged side perspective of the platform unit 14 at table hinge 38 is shown with the pivoting platform 24 positioned in its horizontal position. The stationary leaf 54 of the table hinge 38 remains fixed in a vertical position. The pivoting leaf 52 pivots about the pin 50 of the table hinge 38.

The stationary leaf 54 is affixed to the central bulkhead 22 by two long bolts 64 secured by nuts 66. Positioned between the central bulkhead 22 and the stationary leaf 54 is a stationary L-brace 56 that supports and distributes the forces on the table hinge 38, the stationary platform 20, and the central bulkhead 22 when the apparatus is operated. The long bolt members 64 pass through apertures drilled through the stationary L-brace 56. The L-brace 56 is secured to the stationary platform 20 by screws 68.

The pivoting leaf 52 is affixed to a pivoting L-brace 58 by two short bolts 60 secured by nuts 62. The pivoting L-brace 58 is also affixed to the pivoting platform 24 by screws 68 and supports and distributes the forces on the table hinge 38 and pivoting platform 24 when the back conditioning apparatus 10 is operated. The short screw members 60 pass through apertures drilled through the pivoting L-brace 58.

When the pivoting platform 24 is in the horizontal position and the user engages the grippable actuator control 36 to raise the pivoting platform 24, the pivoting platform 24 rotates in a clockwise direction about the axis located along the pin 50. It is to be understood that the table hinge is split into two segments for operation of the split pivotal platform described.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An exercising and strengthening apparatus for the lumbar region abdominal muscles and leg muscles of a human subject, the apparatus comprising:

a frame means for supporting loads applied to the apparatus by the subject and for transferring the loads to ground;

a stationary platform mounted on the frame means with a top surface means for receiving the head, upper-body, torso and lumbar portions of the subject while in a supine position, the stationary platform having a top edge configured to be located proximate the hip of the supine subject;

a pivotable platform mounted on the frame means with a top surface means for supporting the legs of the subject, the pivotable platform having a first end with pivot means located proximate the top edge of the stationary platform for pivoting the pivotal platform about a horizontal pivoting axis lying generally at the level of the top surface means of the stationary platform;

an actuating unit having an actuating means mounted to the frame means for pivoting the pivotable platform, the actuating means having an extension member pivotally attached to the pivotable platform, the actuating unit having further, drive means for extending and contracting the extension member to pivot the pivotable platform through a selected angle from the horizontal plane, allowing the subject to apply muscular resistance to oppose the motion of the pivotable platform wherein the top surface means of said pivotal platform includes a smooth slide surface area covering only a portion of said top surface means and configured to be positioned under, the lower legs and feet of a supine subject that allows for sliding adjustment of the legs of the subject on the pivotal platform as the platform is pivoted; and a hand-held actuator control, connected to the drive means of the unit, the actuator control having control means for allowing the user to extend, contract, or halt motion of the extension member of the actuating means of the actuating unit, the motion corresponding to decreasing, increasing, or fixing stationary the angle from the horizontal plane of the pivotable platform.

2. The apparatus of claim 1 wherein the extension member of the actuating means pivots the pivotable platform at most 110 degrees from the horizontal.

3. The apparatus of claim 2 wherein the actuator control has additional means for controlling the angular speed of the pivoting platform.

4. The apparatus of claim 1 wherein the actuating unit is remotely connected to the actuator control and transmits a signal to the actuator control allowing the user to lengthen, contract, or halt motion of the actuating unit, corresponding to decreasing, increasing, or fixing stationary the angle from the horizontal plane of the pivotable platform.

5. The apparatus of claim 1 wherein the apparatus has connecting straps attached to the frame means that fit over the abdomen of the subject to maintain contact between the lower-back of the subject and the stationary platform.

6. The apparatus of claim 1 wherein the top surface means of the pivotal platform is split into two segments for separate support of each leg of a supine subject.

7. The apparatus of claim 1 wherein the top surface means of the stationary platform means and the top surface means of the pivotal platform, excepting the smooth slide surface area has a padded covering.

8. The apparatus of claim 7 wherein the padded covering of the top surface means has removable cut-out segments of padded covering for the comfort of a subject.

9. The apparatus of claim 1 wherein the extension member of the actuating means comprises a screw and the drive means comprises a reversible motor.

* * * * *